US008721775B2

(12) United States Patent
Chesebrough

(10) Patent No.: US 8,721,775 B2
(45) Date of Patent: May 13, 2014

(54) ELECTROSTATIC AIR FILTER

(76) Inventor: Jeff Chesebrough, Cambridge (CA)

( * ) Notice: Subject to any disclaimer, the term of this patent is extended or adjusted under 35 U.S.C. 154(b) by 509 days.

(21) Appl. No.: 13/067,202

(22) Filed: May 17, 2011

(65) Prior Publication Data

US 2011/0277637 A1 Nov. 17, 2011

(51) Int. Cl.
*B03C 3/155* (2006.01)

(52) U.S. Cl.
USPC ..... 96/66; 96/69; 96/98

(58) Field of Classification Search
USPC ..... 96/66, 69, 96–98
See application file for complete search history.

(56) References Cited

U.S. PATENT DOCUMENTS 4,549,887 A 10/1985 Joannou
5,059,218 A * 10/1991 Pick ..... 96/66
5,108,470 A * 4/1992 Pick ..... 96/58
5,474,599 A * 12/1995 Cheney et al. ..... 96/55
5,573,577 A * 11/1996 Joannou ..... 96/66
5,846,302 A * 12/1998 Putro ..... 96/66
6,955,708 B1 * 10/2005 Julos et al. ..... 95/59
8,470,084 B2 * 6/2013 Ji et al. ..... 96/69
2002/0170435 A1 * 11/2002 Joannou ..... 96/66

FOREIGN PATENT DOCUMENTS

CA 1272453 8/1990
CA 2421435 9/2001
CA 2270976 4/2003
CA 2635729 12/2006
JP 55-24561 A * 2/1980 ..... 96/66

* cited by examiner

*Primary Examiner* — Richard L Chiesa

(57) ABSTRACT

The electronic air filter has a pair of pads between which a grid is sandwiched. The pads are composed of glass fiber or like filtering medium while the grid is composed of two or more pads of carbon interconnected by a network of filaments having a cotton core surrounded by a graphite sheath. The grid is connected to a source of electrical power at a voltage at which a corona field develops around the grid with resulting polarization of the grid.

18 Claims, 6 Drawing Sheets

ELECTROSTATIC AIR FILTER

This application claims priority pursuant to 35 U.S.C. 119 of Canadian patent application no. 2,704,384 filed May 17, 2010 the entire contents of which are herein incorporated by reference.

FIELD OF THE INVENTION

This invention relates to filters for removing volatile organic compounds, ozone, dust and other air-borne impurities from air and more particularly to electronic air filters which agglomerate microscopic air-borne particles into a size large enough to be trapped by a conventional air filter composed of glass fibre.

BACKGROUND OF THE INVENTION

Electronic air filters having conductive polarizing screens are well known and are described in a number of patents including U.S. Pat. No. 4,549,877, Canadian patents no. 1,272,453 and no. 2,270,976, and Canadian patent applications no. 2,635,729 and no. 2,421,435 The U.S. patent describes a pair of outer hinged screens for enclosing a pair of glass fibre pads between which a grid made up of coarse wire mesh is located. The outer screens are grounded while the grid is charged to about 7 kv, with resulting polarization of the glass fibres and agglomeration and entrapment of air-borne particles in the air which flow through the screens.

Existing electronic air filters have many shortcomings of which the production of ozone may be the most serious. Ozone is a highly undesirable by-product of the electronic filtering process, not only because of its pungent unpleasant odour but because of its toxicity. Another shortcoming of known electronic air filters is that a relatively large amount of power is required for the filters to operate effectively. An additional shortcoming is that the wires within the filter occupy a significant portion of the passageway for the flow of air through the filters and as a result restrict the volume of air that is filtered.

I have invented an, electronic air filter which overcomes or substantially reduces those shortcomings. My air filter requires a voltage lower than is generally required to create a corona field around a grid for polarizing the grid with resulting production of relatively little ozone. Moreover, incorporated into the grid of my air filter are strips of carbonaceous material which function to absorb much of the volatile organic compounds in the air which flow through the filter.

As far as power consumption and restriction of air flow are concerned, the grid within the filter of my invention is made up largely of electrically conductive filaments of small diameter. Not only do the filaments consume less power than the wires in most conventional electronic air filters but they occupy less space and accordingly allow more air to flow through the filter with a resulting increase in the efficiency of the electronic filtering process.

SUMMARY OF THE INVENTION

Briefly, the electronic air filter of my invention includes: a pair of spaced apart pads composed of non-conducting polarizable, air-permeable filtering medium for trapping air-borne particles. Disposed between the pair of pads is a grid composed of conducting filaments and one or more spaced apart carbonaceous strips. The air filter also includes means for raising the voltage of the grid to a level at which a corona field develops around the grid with resulting polarization of the pair of grid.

DESCRIPTION OF THE DRAWINGS

The electronic air filter of the invention is described with reference to the accompanying drawings in which.

Like reference characters refer to like parts throughout the description of the drawings.

DESCRIPTION OF PREFERRED EMBODIMENTS

Figure 1:
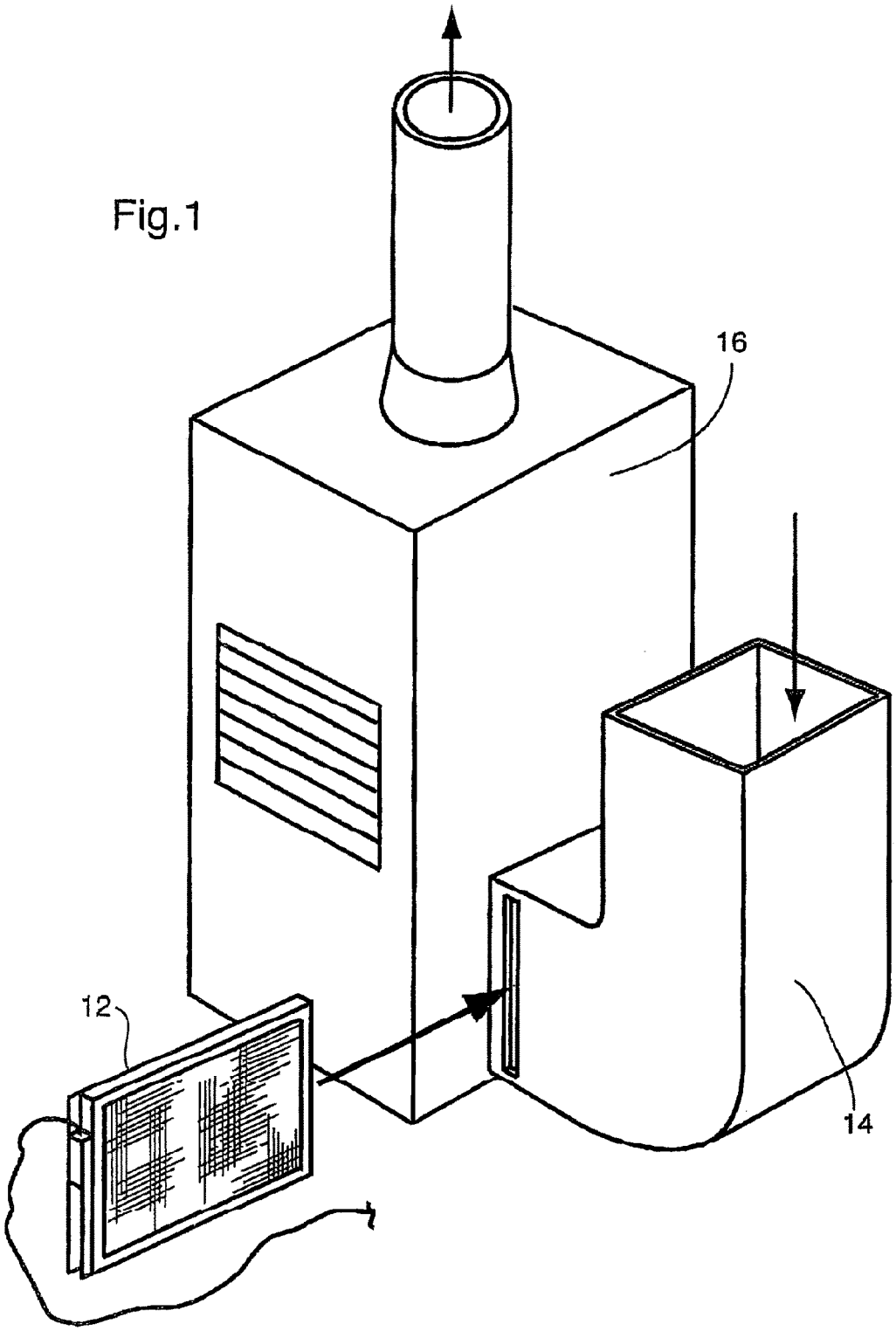
FIG. 1 is a perspective view of the air filter of the invention mounted within a pair of screens and a conventional forced air furnace.

With reference to FIG. 1, the air filter of the invention is mounted within a pair of screens 12. The filter and screens are mounted in a stream of air flowing through the cold air duct 14 of a conventional forced air furnace 16.

Figure 2:
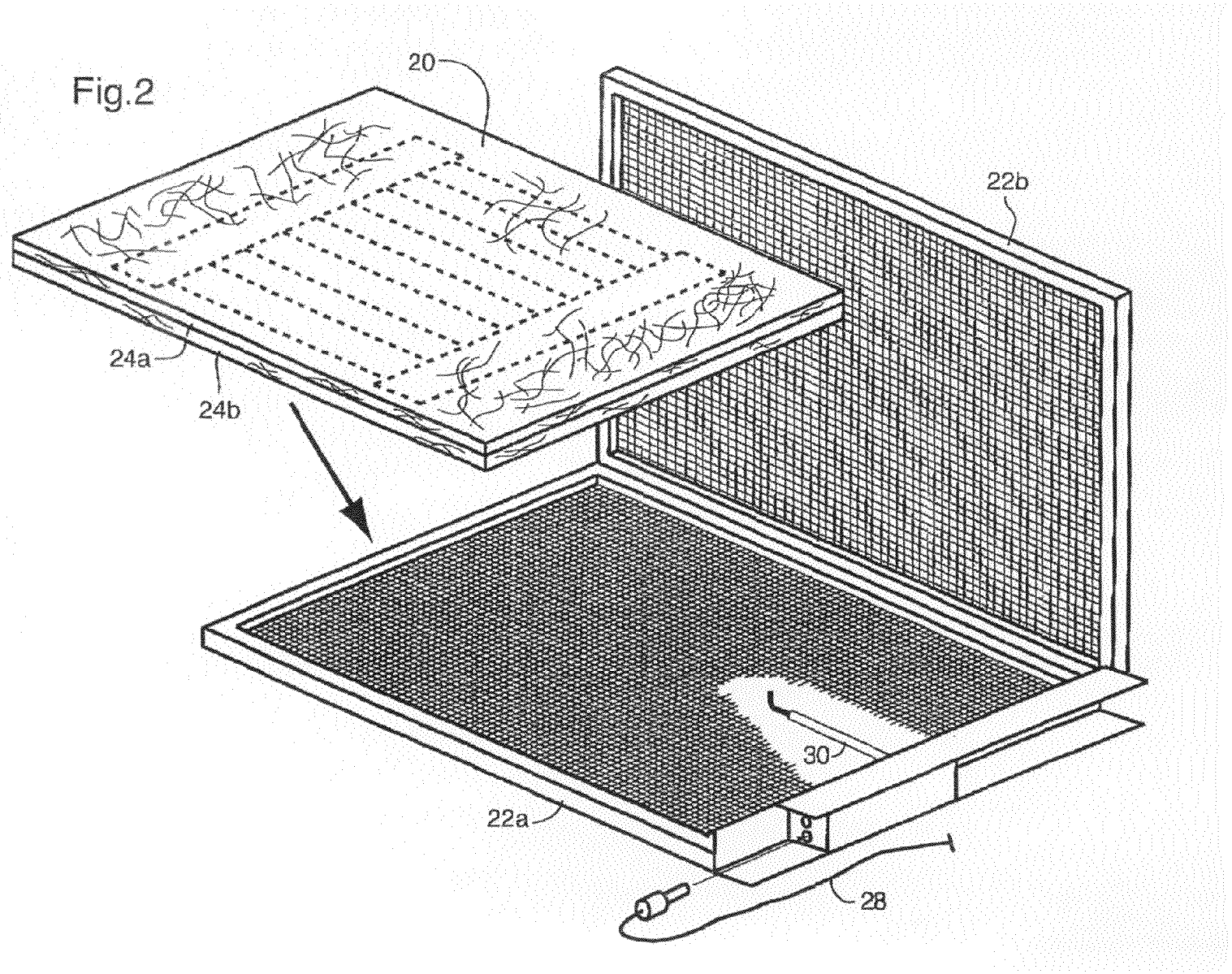
FIG. 2 is a perspective view of a the air filter and a pair of hinged screens opened to admit the air filter.
Figure 3:
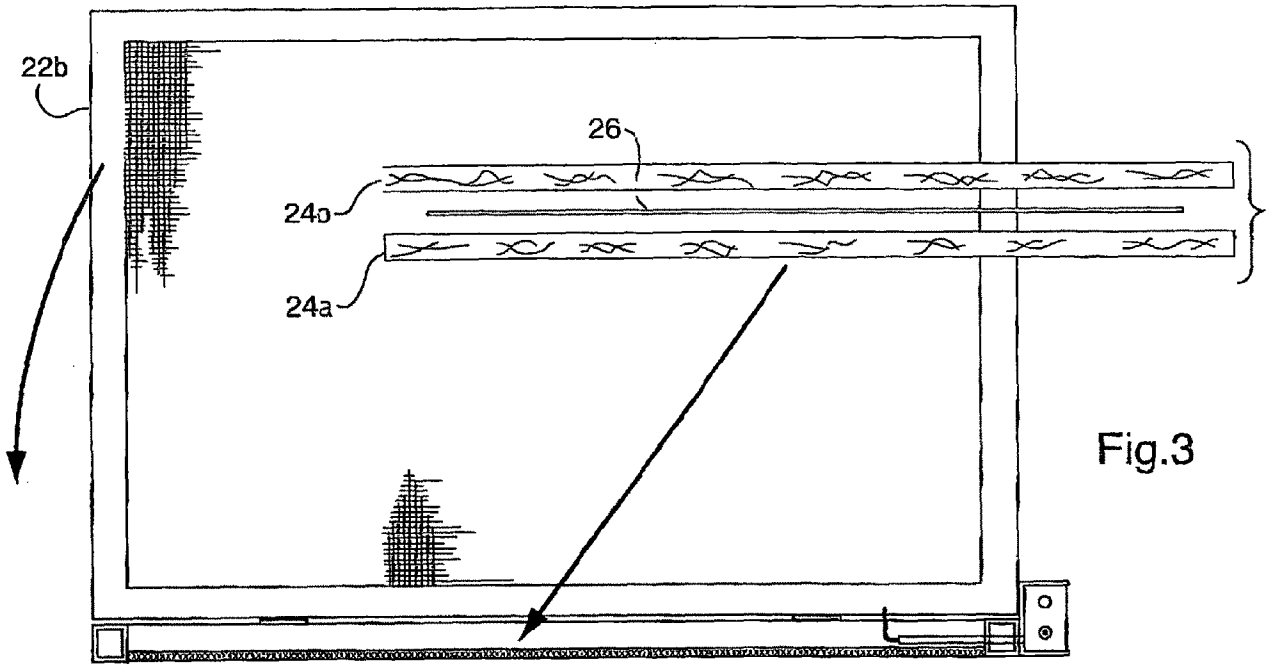
FIG. 3 is an elevation of the screens and falter as they are depicted in FIG. 2.
Figure 4:
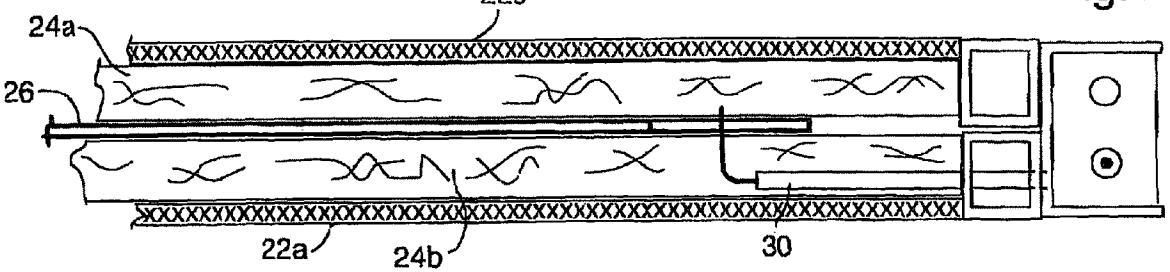
FIG. 4 is a section of the screens as they appear when closed together with a section of the air filter accommodated between the screens.

With reference to FIGS. 2, 3 and 4, the air filter of the invention, generally 20, is shown in conjunction with a pair of outer hinged screens 22*a,b* which enclose the air filter. The filter is composed of a pair of filtering pads 24*a,b* between which a grid 26 is located. The lower screen is connected to the ground by means of wire 28 while the grid is charged by means of probe 30 beneath the grid.

Each filtering pad is composed of material which traps air-borne particles and which is non-conducting, polarizable and air-permeable. Preferably, the pads are composed of conventional glass fibre.

Figure 5:
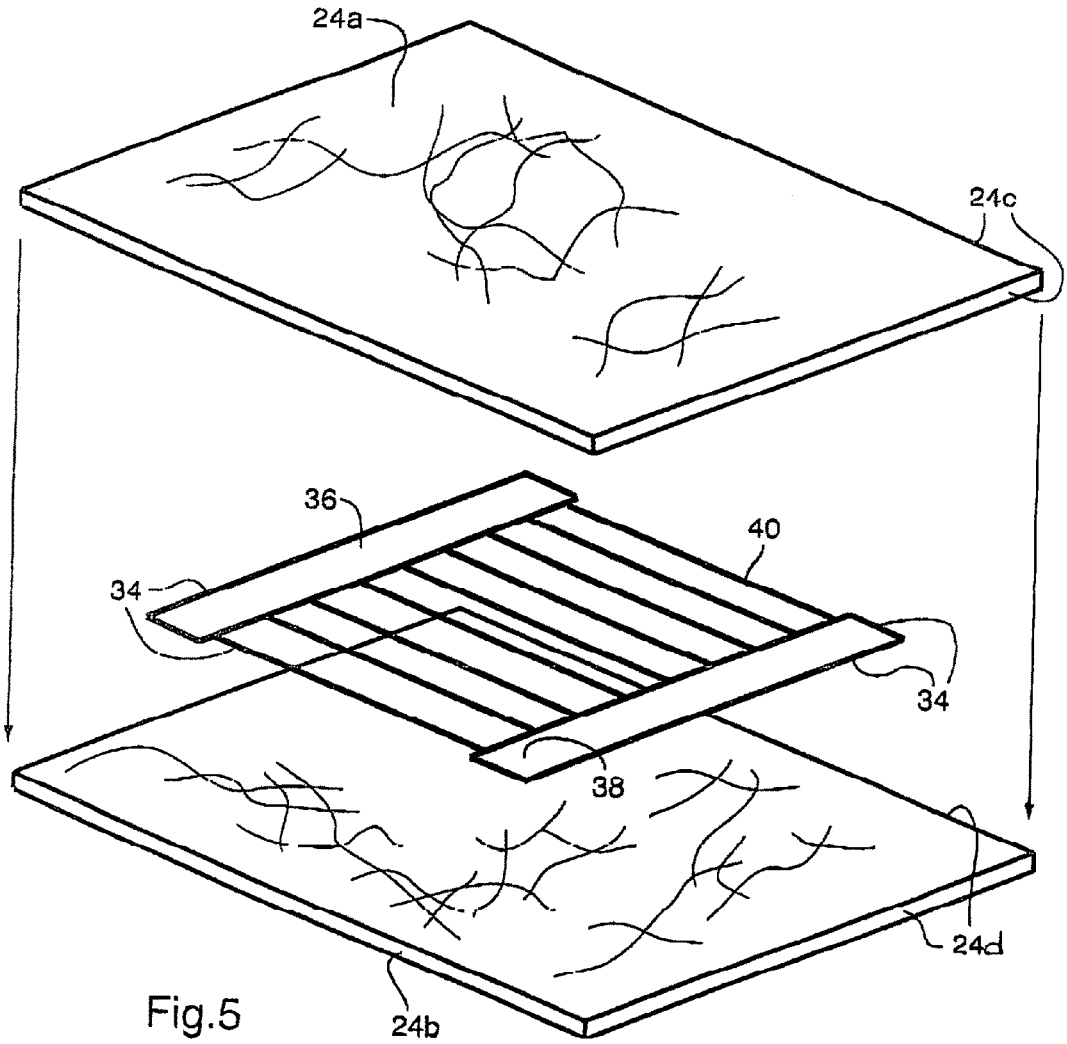
FIG. 5 is in exploded perspective view of the air filter.

With reference to FIG. 5, the grid has a rectangular perimeter 34 and is made up of two parallel electrically conducting carbonaceous strips 36,38 which run along opposite ends of the grid and a number of parallel strands of a filament 40 which run parallel to the sides of the grid and which are rectangular to the carbonaceous strips. The strips are electrically conducting and are preferably composed of an inert substrate impregnated with particles of carbon or graphite. The filaments are also electrically conducting and preferably have a cotton core surrounded by a graphite cover or coating.

The grid is electrically charged by means of probe 30 which is provided with a pointed pointed end for piercing the lower filtering pad 24*b*. The probe extends through the pad and into electrical contact with carbonaceous strip 38. The probe is connected to a source of electrical current at elevated voltage and low amperage. The voltage must be sufficient to produce a corona field abound the grid with resulting polarization of the grid. The preferred voltage is in the range of about 5 to about 9 kv.

The pads are held together by means of an adhesive which is applied to the area of the pads at or within the perimeter 40 of the grid. The adhesive is not applied to the pads elsewhere.

Specifically the adhesive is not to be applied to the area of the filtering pads adjacent to their outer edges 24*c, d*. Alternatively, the adhesive can also be applied to one both sides of the grid before it is sandwiched between the two pads.

Figure 6:
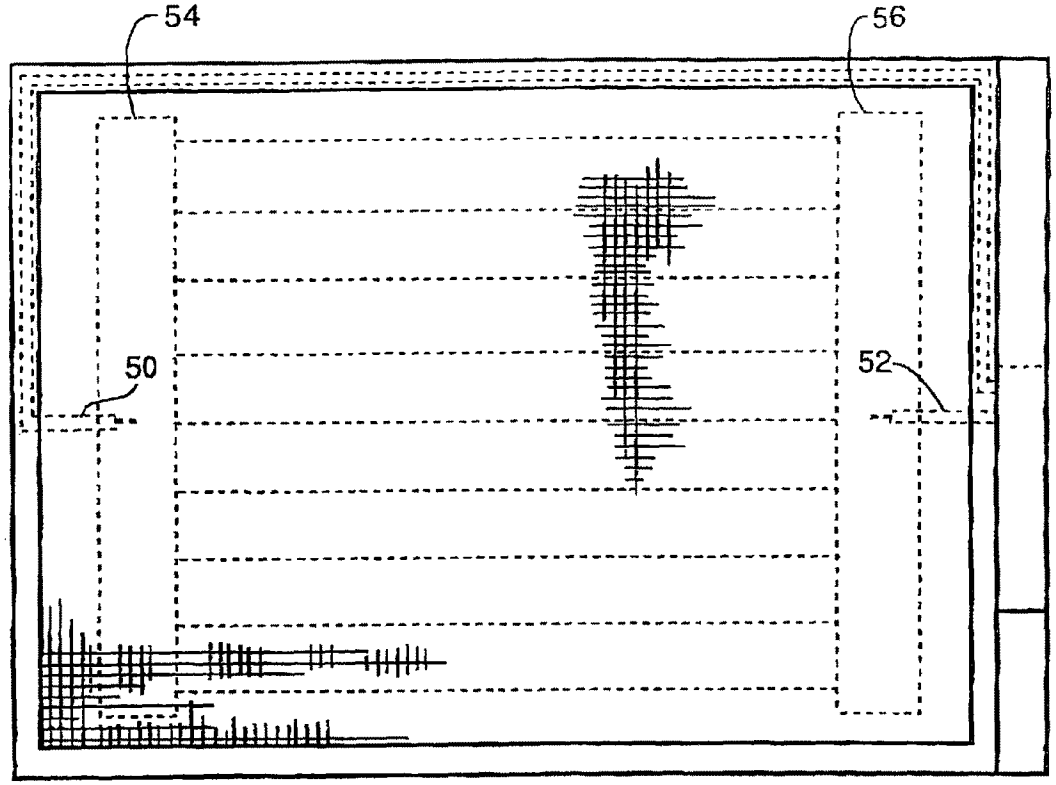
FIG. 6 is a plan view of a second embodiment of the air filter and screen.
Figure 7:
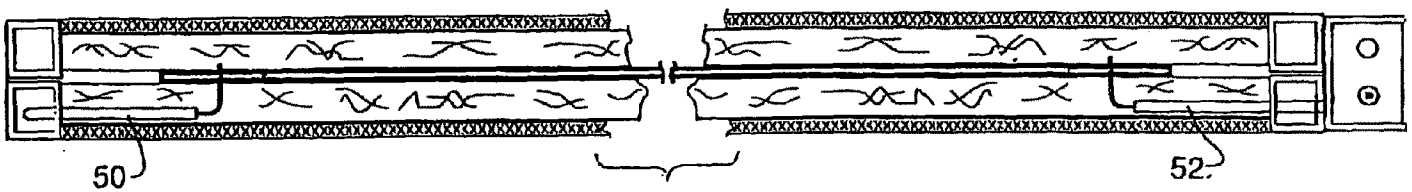
FIG. 7 is a section of the screens and filter pad illustrated in FIG. 6.

With reference to FIGS. 6 and 7, the pads and grid are the same as those depicted in the previous drawings. However, instead of a single probe for charging the grid, two probes 50, 52 are provided for that purpose. One probe 50 is electrically connected to carbonaceous strip 54 of the grid while the other probe 52 is connected to the other carbonaceous strip 56.

Figure 8:
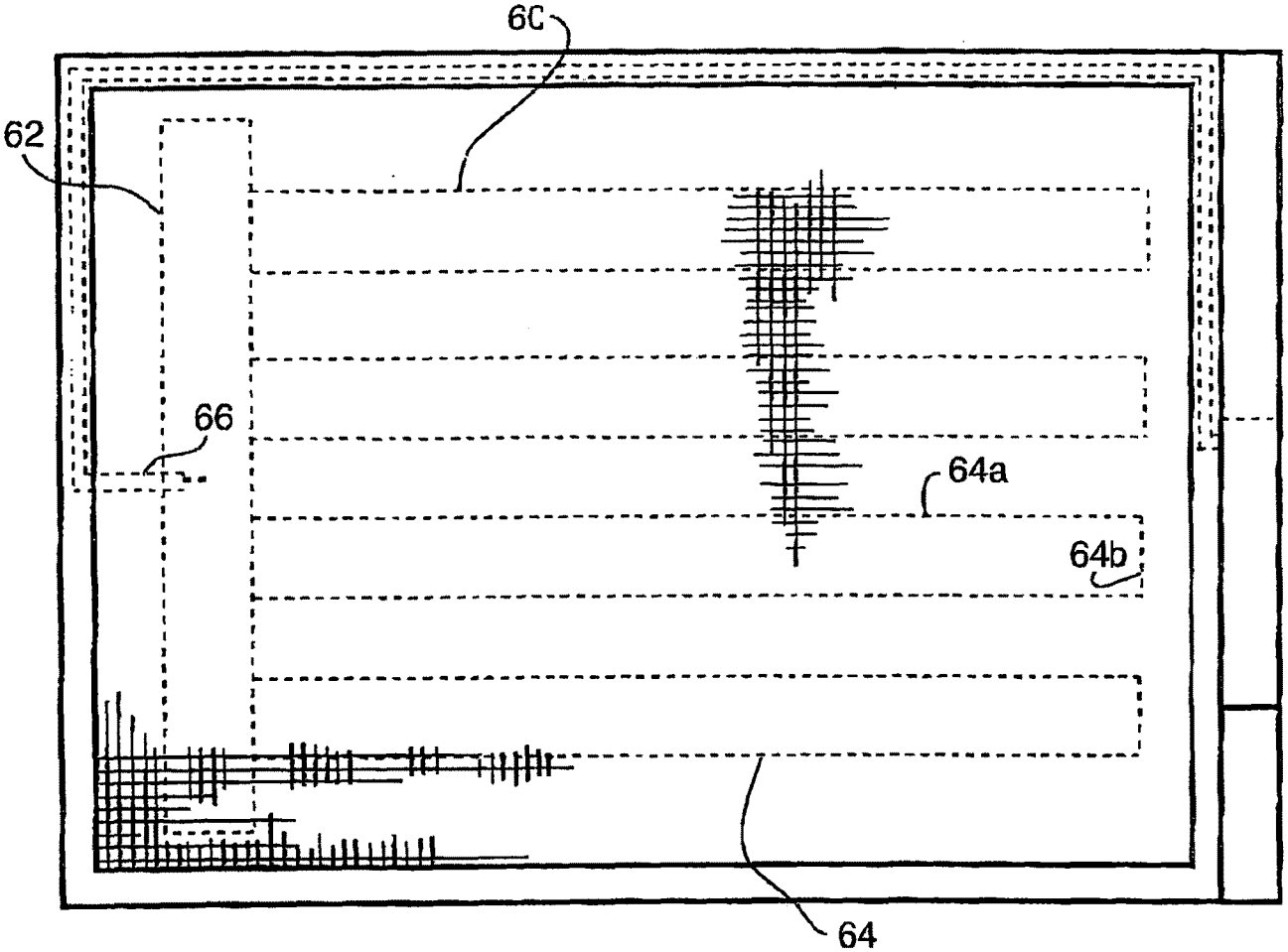
FIG. 8 is a plan view of a third embodiment of the air filter.

The grid 60 depicted in FIG. 8 is the same as that depicted in the previous drawings except that the grid is provided with only one carbonaceous strip 62. As well, filament 64 is composed of a network of parallel strands 64*a* interconnected at their ends 64*b* remote from the carbonaceous strip and only one probe 66 is provided for charging the grid.

It will be understood, of course, that modifications can be made in the structure of the electronic air filter of (be invention without departing from the scope of the invention as defined in the appended claims.

I claim:

1. An electronic air filter including: a pair of spaced apart pads composed of non-conducting polarizable, air-permeable filtering medium for trapping air-borne particles; a grid disposed between said pair of pads, said grid being composed of an electrically conducting filament and a carbonaceous strip; and means for raising the voltage of said grid to a level at which a corona field develops around said grid with resulting polarization of said grid.

2. The electronic air filter of claim 1 wherein said grid includes at least two spaced apart carbonaceous strips.

3. The electronic air filter of claim 2 wherein said grid is composed of two spaced apart said carbonaceous strips and said filament extends between said carbonaceous strips.

4. The electronic air filter of claim 1 wherein said pads have an outer edge within which said grid is disposed, said grid being spaced apart from and within said outer edge.

5. The electronic air filter of claim 4 wherein said grid includes at least two carbonaceous strips and said carbonaceous strips are parallel to one another and rectangular to said filament, said filament being made up of a number of parallel strands spaced apart from one another.

6. The electronic air filter of claim 4 wherein said grid has a perimeter and said pads are bonded to each other in an area defined by said perimeter but otherwise are not bonded to each other.

7. The electronic air filter of claim 4 wherein said grid is bonded to at least one of said pads, said grid having a perimeter and said pads are bonded to each other in an area defined by said perimeter but otherwise are not bonded to each other.

8. The electronic air filter of claim 4 wherein said pads are both bonded to said grid but otherwise are not bonded to each other.

9. The electronic air filter of claim 1 wherein said filaments are composed of a cotton core surrounded by a graphite coating.

10. The electronic air filter of claim 1 wherein said trapping medium is glass fibre.

11. An electronic air filter including: a pair of spaced apart pads composed of non-conducting polarizable, air-permeable glass fibre for trapping air-borne particles; a grid disposed between said pair of pads, said grid being composed of a carbonaceous strip and an electrically conducting filament made up of a cotton core surrounded by a graphite coating; and means for raising the voltage of said grid to a level at which a corona field develops around said grid with resulting polarization of said pair of pads.

12. The electronic air filter of claim 11 wherein said grid includes at least two spaced apart carbonaceous strips.

13. The electronic air filter of claim 12 wherein said grid is composed of two spaced apart said carbonaceous strips and said filament extends between said carbonaceous strips.

14. The electronic air filter of claim 11 wherein said pads have an outer edge within which said grid is disposed, said grid being spaced apart from and within said outer edge.

15. The electronic air filter of claim 14 wherein said grid includes at least two carbonaceous strips and said carbonaceous strips are parallel to one another and rectangular to said filament, said filament being made up of a number of parallel strands spaced apart from one another.

16. The electronic air filter of claim 14 wherein said grid has a perimeter and said pads are bonded to each other in an area defined by said perimeter but otherwise are not bonded to each other.

17. The electronic air filter of claim 14 wherein said grid is bonded to at least one of said pads, said grid having a perimeter and said pads are bonded to each other, in an area defined by said perimeter but otherwise are not bonded to each other.

18. The electronic air filter of claim 14 wherein said pads are both bonded to said grid but otherwise are not bonded to each other.

* * * * *